US005516088A

United States Patent [19]

Coffin, III

[11] Patent Number: 5,516,088

[45] Date of Patent: May 14, 1996

[54] ADJUSTABLE CLAMP

[75] Inventor: Louis F. Coffin, III, San Jose, Calif.

[73] Assignee: Mapletek Engineering, Inc., Sunnyvale, Calif.

[21] Appl. No.: 273,383

[22] Filed: Jul. 11, 1994

Related U.S. Application Data

[63] Continuation-in-part of Ser. No. 88,180, Jul. 7, 1993, Pat. No. 5,346,194.

[51] Int. Cl.[6] ..... B25B 1/14

[52] U.S. Cl. ..... 269/166; 269/228; 269/283

[58] Field of Search ..... 269/91–94, 166–173, 269/228, 283

[56] References Cited

U.S. PATENT DOCUMENTS

| | | | |
|---|---|---|---|
| 1,643,557 | 9/1927 | Goldman | 269/170 |
| 2,781,803 | 2/1957 | Nelson | 269/166 |
| 3,096,975 | 7/1963 | Irwin | 269/169 |
| 3,748,936 | 7/1973 | Minasy | 269/228 |
| 4,083,548 | 4/1978 | Mackbarth | 269/228 |
| 5,143,359 | 9/1992 | Bush | 269/283 |

*Primary Examiner*—Robert C. Watson

*Attorney, Agent, or Firm*—Townsend and Townsend and Crew

[57] ABSTRACT

An improved carpenter's clamp is provided for easily securing a workpiece. The clamp has a C-shaped frame that can be mounted to a holding surface. The frame has a top and a bottom receiver aperture. A slide bar is slidably mounted in an axial direction within the top and bottom receiver apertures, and a handle is pivotally attached to the frame to provide a downward axial force to the slide bar when the handle is lowered. A toggle link is provided allowing the handle to be locked in a downward position thereby locking said slide bar in a secured position. A holding arm having a holding tip at a distal end is slidably mounted to the slide bar, and the slide bar is positioned between a pair of bias pins on the holding arm so that a workpiece can be held between the holding surface and the holding tip when a downward force is applied to the handle.

19 Claims, 7 Drawing Sheets

ADJUSTABLE CLAMP

CROSS REFERENCE TO RELATED APPLICATIONS

This application is a continuation in part application of U.S. patent application Ser. No. 08/088,180, filed Jul. 7, 1993, now U.S. Pat. No. 5,346,194, the disclosure of which is herein incorporated by reference.

BACKGROUND OF THE INVENTION

1. Field of the Invention

The present invention relates generally to adjustable clamps and more particularly to portable, carpenter's clamps suitable for holding work pieces such that they may be sawn without being marred.

2. Description of the Background Art

Adjustable clamps are commonly used mechanisms for securing a piece of work in a fixed position such that various tools may be applied to it and the contours of the work modified. The classic C-clamp is adjusted by turning a screw bolt to which a holding surface is attached. That surface is placed in opposition to a stationary holding surface at the opposite end of the clamp and the work is placed in between. The screw bolt is turned such that the work is held between the two opposed holding surfaces.

Toggle clamps are used in industry for holding the same size work piece for either repeated machining operations or the same operation on many identical pieces. Thus, these toggle clamps are adjusted once for a large run of similar workpieces. Attempts to adapt the toggle clamp to the home workshop have encountered a number of problems in that the home workshop requires a clamp capable of use with a number of problems in that the home workshop requires a clamp capable of use with a number of differently sized pieces and a variety of operations. The existing toggle clamps are difficult to adjust and have a limited range of adjustment, thus making them unsuitable for applications where a large number of variously sized and shaped workpieces are employed.

The present invention is more suitable for home use in that it adjusts rapidly to any size of workpiece within the capacity of the clamp. The invention also provides a safe and comfortable handle. The gripping of the handle also serves to retain the lever in its closed position during use.

The C-clamp has been improved on by the addition of either a toggle or cam assembly attached to a handle, placed such that the operation of the handle urges one holding surface toward the other, thus applying pressure to the work and gripping it. An additional improvement to the C-clamp has been the use of a slide-bar assembly wherein one holding surface is free to travel along a portion of the frame. Pressure applied to the holding surface induces a bias in the holding arm, thereby causing a binding of the holding arm of the slide-bar.

SUMMARY OF THE INVENTION

It is therefore an object of the present invention to provide an improved clamp providing for rapid adjustability through a large range of motion, efficient use of mechanical advantage, both to hold the work safely and securely and to provide an easily set and released locking feature.

It is a further objective of the invention to provide an integrated clamp frame and handle such that if the clamp is mobile rather than stationary the handle-frame assembly serves as a grip and safety lock.

It is an additional objective of the invention to provide a replaceable holding surface that will not mar the work nor harm a saw or other tool that may come into contact with it during normal usage.

Briefly, in the preferred embodiment, the present invention comprises a rigid vertical frame roughly in the form of a C and having openings at each end through which a rigid bar may slide. The slide bar fits within the two holes at the extremities of the frame and is free to travel vertically within. A handle is attached to the superior end of the frame such that it may rotate around a pivot bolt connecting the two. A toggle link connects the slide bar and handle such that when the handle is raised the slide bar travels upward within the frame.

When lowered, the handle conforms to the frame, and an over-center locking means holds the handle in place. A holding arm having a holding tip or surface at one end and an opening in the other is attached to the slide bar by having the slide bar pass through the opening in the holding arm. The holding arm may thus travel along the slide bar. The steel pins pass through the holding arm in proximity to the opening such that force applied to the holding arm induces a bias in the holding arm, thereby causing a binding of the holding arm on the slide-bar, while simultaneously forcing a workpiece against a second holding surface, which is attached to the clamp frame.

The holding arm has a replaceable holding tip which serves as the holding surface. The holding tip is typically made of wood or other soft material. A thumbscrew or other holding device may be used to position the holding arm on the slide bar so that multiple workpieces of similar size may be serially held without the necessity of repositioning the holding arm. An additional thumbscrew may be provided at the top of the frame to limit the upward motion of the slide bar, whereby the maximum pressure applied to the work may be regulated. Lesser clamping forces than the maximum are attained by only raising the handle partially within its full range of travel before lowering it to clamp the workpiece.

In an exemplary embodiment, a clamp for clamping a work piece to a mounting surface is provided. The clamp includes a frame having a top end and a bottom end with a receiver aperture being disposed at the bottom end. A slide bar is slidably mounted in an axial direction within the receiver aperture. Driving means are provided to drive the slide bar into the receiver aperture. The driving means includes include a top linkage having a proximal end and a distal end with the top linkage being pivotally attached near the top end of the frame between the proximal and distal ends of the top linkage. The top linkage is pivotally attached at the distal end to the slide bar. The driving means further includes a handle for pivoting the top linkage about the frame to provide a downward axial force to the slide bar. Over-center locking means are provided for securely locking the slide bar in a downward position. A holding arm having a holding surface at a distal end is provided. The holding arm is slidably mounted to the slide bar with the slide bar being positioned between a pair of biasing pins on the holding arm.

In one particular aspect, the handle includes a proximal end for receiving an applied force and a distal end. The distal end is pivotally attached to the proximal end of the top linkage. In another aspect, the over-center locking means comprises a side linkage having a bottom end and a top end with the bottom end of the side linkage being pivotally attached to the frame near the bottom end of the frame. The top end of the side linkage is attached to the handle between the proximal and distal ends and nearest the distal end. With this configuration, movement of the proximal end of the handle toward the bottom end of the frame causes the top end of the side linkage to move past a center line extending between the bottom end of the side linkage and the proximal end of the top linkage, i.e. over-center, to lock the handle in a stable snap-over position.

In another particular aspect, the handle includes a proximal end for receiving an applied force and a distal end. The handle is pivotally attached to the proximal end of the top linkage between the proximal and distal ends and nearest the distal end. In yet another aspect, the over-center locking means comprises a side linkage having a bottom end and a top end, the bottom end of the side linkage being pivotally attached to the frame near the bottom end of the frame. The top end of the side linkage is attached to the distal end of the handle. With such a configuration, movement of the proximal end of the handle away from the slide bar causes the top end of the side linkage to move past a center line extending between the bottom end of the side linkage and the proximal end of the top linkage, i.e. over-center, to lock the handle in a stable snap-over position.

In still another particular aspect, the handle includes a proximal end for receiving an applied force and a distal end. The handle is pivotally attached to the frame near the bottom end. In one aspect, the over-center locking means comprises a side linkage having a bottom end and a top end with the bottom end of the side linkage being pivotally attached to the handle proximal to the distal end. The top end of the side linkage is attached to the proximal end of the top linkage. With this configuration, movement of the proximal end of the handle toward the slide bar causes the bottom end of the side linkage to move past a center line extending between the distal end of the handle and the proximal end of the top linkage, i.e. over-center, to lock the handle in a stable snap-over position.

In an exemplary aspect, a slot is disposed at a proximal end of the slide bar with the slot being received within a pin that is disposed across the aperture. Preferably, the slot is curved to maintain the slide bar in a generally axial orientation when the downward driving force is provided.

In one particular aspect, the top linkage is pivotally attached to the frame by a pivot bolt. In another aspect, means are provided for securing the holding arm to the slide bar. Preferably, the securing means comprises a thumbscrew.

In still another aspect, means are provided for limiting the upward travel of the slide bar. Preferably, the limiting means comprises a thumbscrew rotatably retained within the top end of the frame. In another particular aspect, a replaceable tip having a holding surface is attached to the holding arm. Preferably, the replaceable tip is constructed from materials selected from the group consisting of wood, plastic, rubber, and composites.

In an exemplary aspect, the handle substantially conforms to the frame after the handle is lowered to the stable snap-over position with the frame preventing further travel of the handle.

An advantage of the invention is that it is small in size and easily transferrable between work sites.

Another advantage of the invention is that the soft, replaceable tip will not damage tools misapplied to it.

Another advantage of the invention is that the position of the holding arm is easily adjustable throughout a wide range of movement.

Another advantage of the invention is that the handle and frame assembly provide a convenient grip for the work and help prevent accidental release of the work.

Another advantage of the invention is that it maximizes the mechanical advantage available to the user.

Another advantage of the invention is that the clamping pressure applied to the workpiece may be easily adjusted by not cocking the handle to its maximum position before lowering it to engage the workpiece.

Another advantage of the invention is that the frame may be easily secured by a variety of means to a shallow, confined work surface with an inaccessible inferior surface, thus requiring minimal clearance underneath the inferior surface.

These and other objects and advantages of the present invention will no doubt become obvious to those of ordinary skill in the art after having read the following detailed description of the preferred embodiment which is illustrated in the various drawing figures.

DETAILED DESCRIPTION OF THE PREFERRED EMBODIMENT

According to the present invention a clamp, particularly useful in the field of carpentry, is provided. The clamp is able to secure a workpiece between two surfaces in such a manner that the workpiece can easily be shaped or formed by a saw, router, drill, or the like by a carpenter without undue interference from the clamp.

To clamp the workpiece, the present invention provides a holding arm for holding the workpiece to a holding surface. The holding arm is slidably mounted to a shaft capable of moving in an axial direction. The shaft is loosely mounted between two biasing pins on the holding arm thereby allowing the holding arm to be axially slid along the shaft in order to position the workpiece between the holding arm and the holding surface. Once the workpiece is placed beneath the holding arm, the holding arm slightly rotates causing the shaft to be bound between the two biasing pins. A downward axial force is then provided by driving means at the top of the shaft causing the bound shaft to transfer the applied downward force to the end of the holding arm to clamp the workpiece to the holding surface.

The shaft is also slidably attached to a C-shaped frame which is securely mounted to the holding surface. The frame keeps the shaft axially aligned and at the same position relative to the holding surface. Pivotally attached to the frame is the driving means. The driving means has a handle so that mechanical force can be applied to the handle and transferred to the shaft. The handle acts somewhat like a lever so that when a downward force is applied to the handle, an upward force is transferred to the frame. Since the frame is securely attached to the holding surface, the upward force is countered and the driving means (which is attached to the frame) is able to provide a downward force on the shaft to clamp the workpiece to the holding surface.

To allow the workpiece to remain clamped to the holding surface once the downward forced has ceased being applied by the handle, an over-center locking means is provided. The locking means locks the shaft securely in place once the handle has been lowered to conform to the frame.

Figure 1:
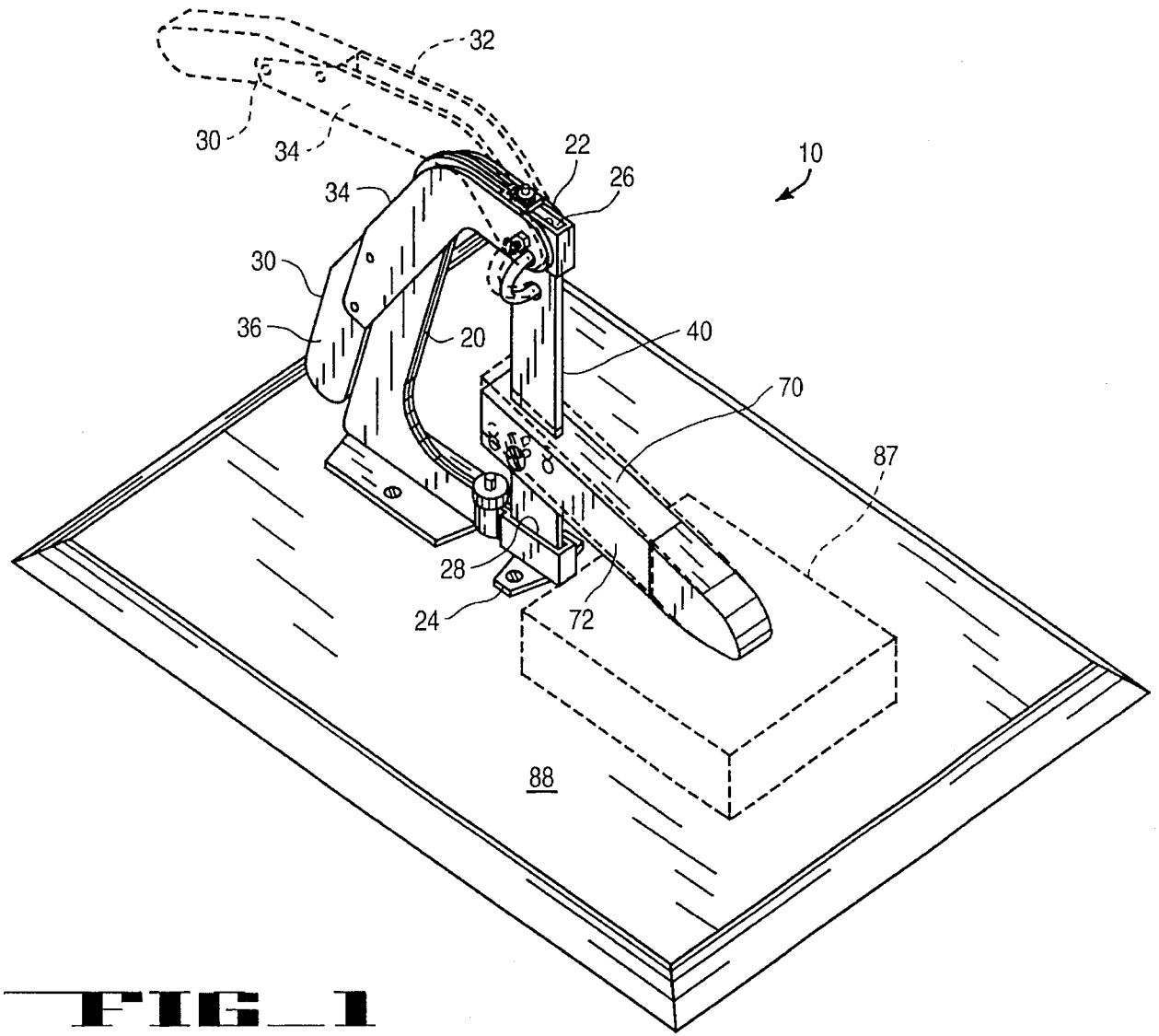
FIG. 1 is a side perspective view of the invention from the front, showing the relative, approximate size and the relationship of the main elements of the invention in the closed position and shadowed in the open position.
Figure 2:
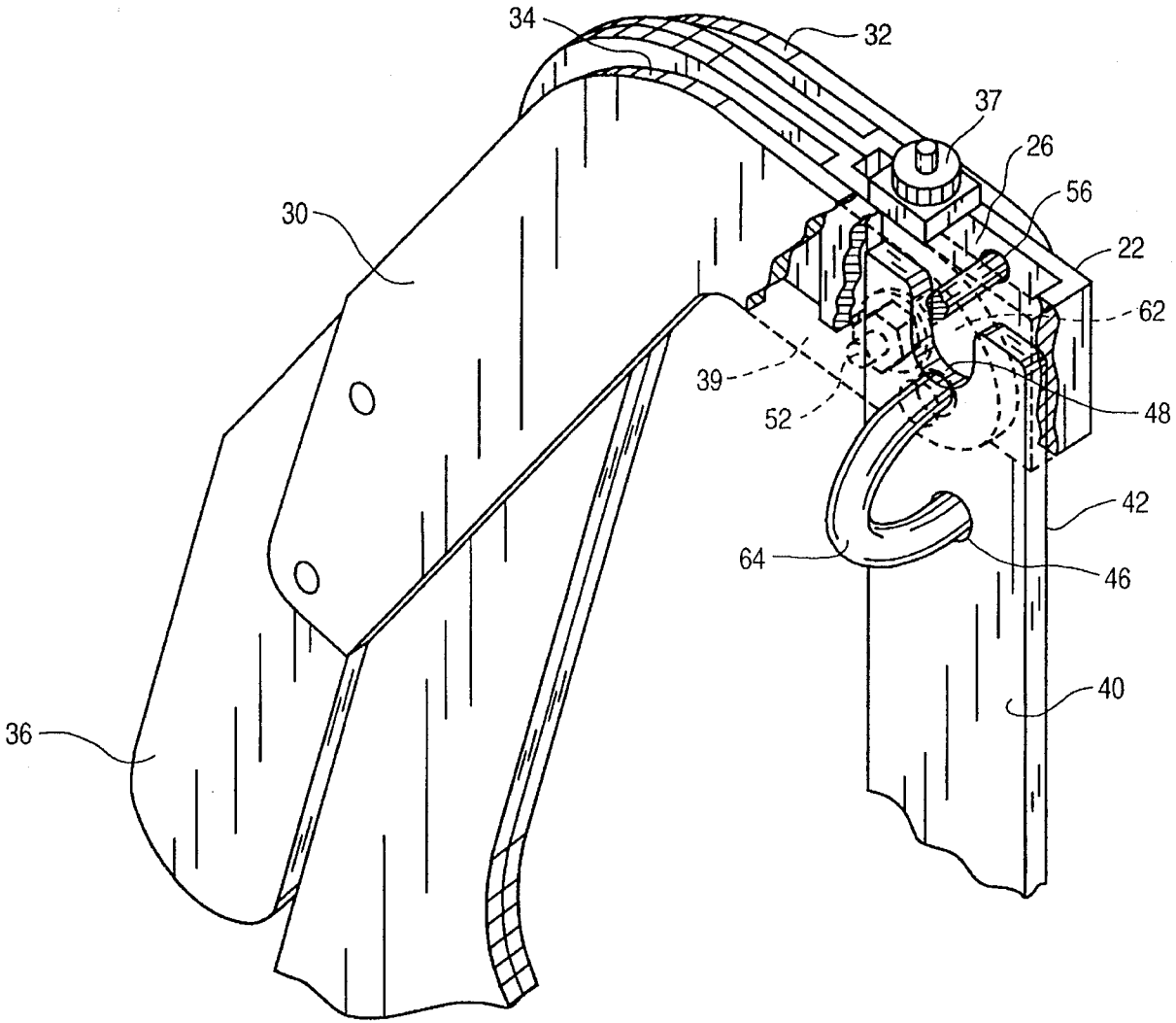
FIG. 2 is a cut-away detail view of the device of FIG. 1, showing the relationship between the toggle assembly, frame, slide bar and handle.
Figure 3:
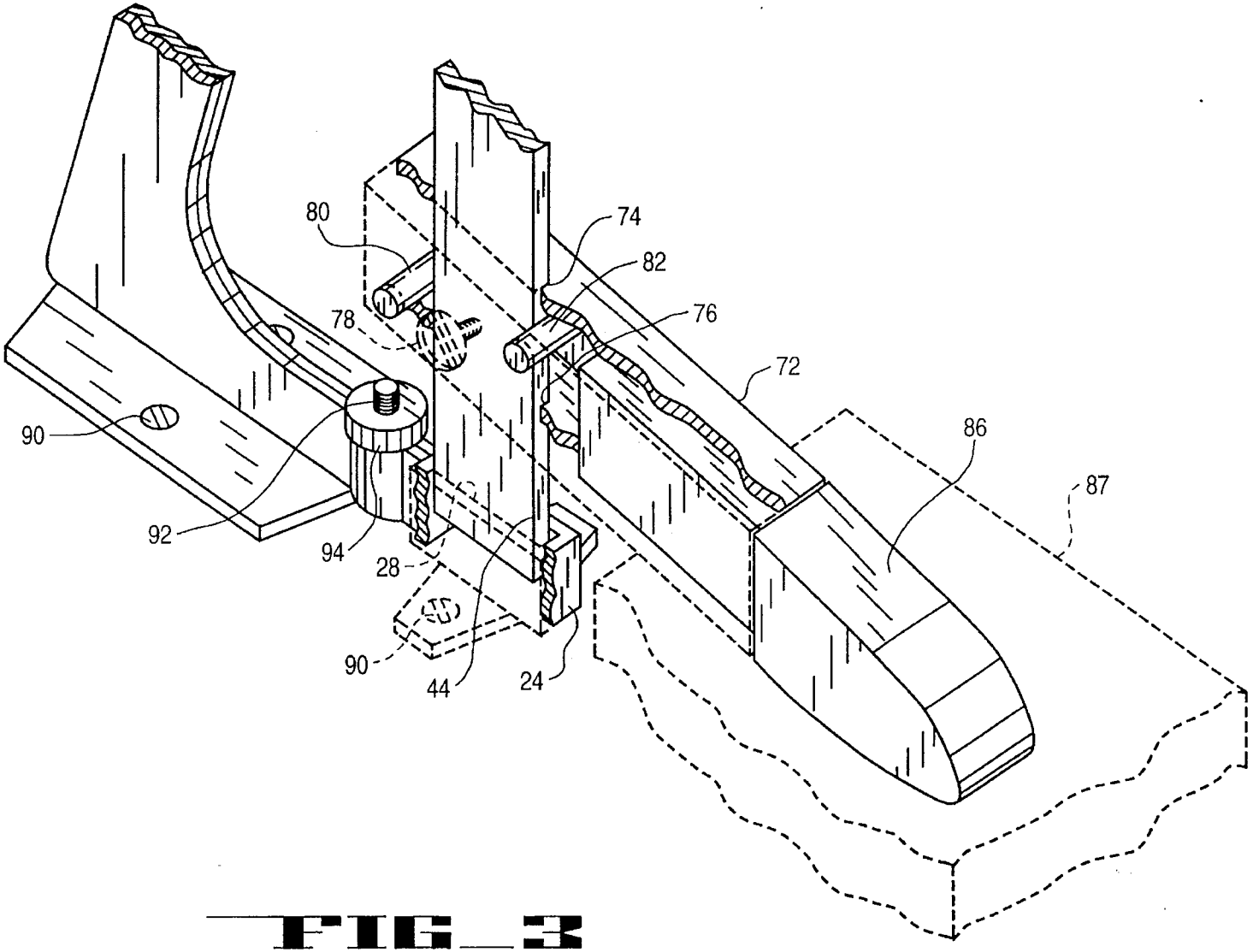
FIG. 3 is a cut away detail view of the device of FIG. 1, showing the slide bar and holding arm assembly.

Turning now to FIGS. 1–3, an exemplary embodiment of the present invention will be described in detail. As shown in FIG. 1, a carpenter's clamp 10 has a C-shaped frame 20 having a top end 22 and a bottom end 24. The middle section of the C-shaped frame 20 provides a convenient handle for the carpenter to grip when clamping or positioning a workpiece. A top receiver slot 26 is formed at the top end 22, and a bottom receiver slot 28 is formed at the bottom end 24. The top and bottom receiver slots 26 and 28 are provided for receiving a slide bar 40 as will be described hereinafter.

A handle 30 is pivotally attached to the top end 22 of the frame 20 by a pivot bolt 52. The pivot bolt passes through a right L member pivot hole 54 (not shown), a right top receiver pivot hole 56, a left top receiver pivot hole 58 (not shown), and a left L member pivot hole 62. The handle is formed by riveting together right L member 32, hand grip 36 and left L member 34. Secured to either the right L member 32 or the left L member 24 is an adjusting thumbscrew 37. As will be described in more detail hereinafter, the thumbscrew 37 limits the upward travel of the slide bar 40. A right receiver hole 38 (not shown) and a left receiver hole 39 are provided for receiving a toggle link 64 as described hereinafter.

A slide bar 40 having a top end 42 and a bottom end 44 is slidably mounted into top receiver slot 26 and bottom receiver slot 28 so that it may travel in an axial direction between the two slots 26 and 28. A pivot slot 48 is formed within the top end 42 of the slide bar 40 to allow further travel of the slide bar 40 in the upward direction. Pivot slot 48 receives pivot bolt 52 as the slide bar 40 travels in an upward direction.

A toggle link hole 46 is provided at the top end 42 of the slide bar 40. The toggle link 64 is C-shaped so that the middle section will pass through the toggle link hole 46 with one end being axially received into the right receiver hole 38 and the other end in the left receiver hole 39. As the handle 30 is raised or lowered, the toggle link 64 can rotate within both the receiver holes 38 and 39 and the toggle link hole 46.

Slidably mounted to the slide bar 40 is a holding arm assembly 70, shown in detail in FIG. 3. The holding arm assembly 70 has a hollow rectangular member 72. A top bar slot 74 and a bottom bar slot 76 are provided for receiving the slide bar 40. Bias bars 80 and 82 are securely mounted to the rectangular member 72. This embodiment allows the rectangular member 72 having a hold arm tip 86 at a distal end to be slidably moved in an axial direction along the slide bar 40. This allows the holding arm tip 86 to be vertically positioned as desired depending on the vertical height of a workpiece 87 to be secured beneath the holding arm tip 86. A retaining thumbscrew 78 is conveniently provided to maintain the rectangular member 72 in a desired position. When the workpiece 87 is positioned between the holding arm tip 86 and a holding surface 88, the rectangular member 72 is slightly rotated causing it to be bound between the bias bars 80 and 82. In this manner, any downward force applied to the slide bar 40 is transferred to the holding arm tip 86.

The thumbscrew 37 is provided at the top end 22 of the frame 20 to limit the upward travel of the slide bar 40. As the handle grip 36 is lifted, the slide bar 40 is raised until it touches the bottom of the thumbscrew 37 thereby limiting the upward movement of the slide bar 40 and the handle grip 36. To adjust the height to which the handle grip 36 can be raised, the thumbscrew 37 is adjusted by screwing it up or down. By limiting the travel of the slide bar 40, the maximum pressure applied to the workpiece 87 is also regulated. In this manner, the thumbscrew 37 allows the pressure applied to the workpiece 87 to be regulated regardless of the height of the workpiece 87.

To clamp the workpiece 87 between the holding arm tip 86 and the holding surface 88, the handle grip 36 is pushed downward from a starting position (shown in phantom in FIG. 1). Applying a downward force on the handle grip 36 causes the slide bar 40 to move in a downward direction via the toggle link 64 thereby causing the rectangular member 72 and the holding arm tip 86 to also move in a downward direction as previously described. As the handle grip 36 is forced downward, it remains in an unstable position. What is meant by an unstable position is that if the downward force is removed from the handle grip 36, the handle grip 36 will tend to move upward, and the slide bar 40 will not be securely locked in a downward position. As the handle grip 36 is lowered to a point where it substantially conforms to the frame 20, the toggle link 64 moves "over-center" and a stable "snap-over" position is reached. The frame 20 also serves to prevent further travel of the handle grip 36 after the "over-center" position is reached. At the stable "snap-over" position all the forces are balanced allowing the slide bar 40 to be securely locked in the downward position and the handle grip 36 to be securely maintained in a position such that it substantially conforms to the frame 20. In this position, the workpiece 87 is securely clamped beneath the holding arm tip 86 until being released by lifting the handle grip 36 in an upward direction.

Once the workpiece 87 is secured beneath the holding arm tip 86, the frame 20 may be grasped to further position the frame 20, the holding surface 88, and the clamped workpiece 87. In this manner, a carpenter can conveniently position the secured workpiece 87 as desired by merely grasping and positioning the frame 20.

Mounting holes 90 are provided at the bottom end 24 of the frame 20 to allow the frame 20 to be secured the holding surface 88. A bolt 92 along with a nut 94 can also be used to secure the frame 20 to the holding surface 88 from a bottom side of the holding surface.

Figure 4:
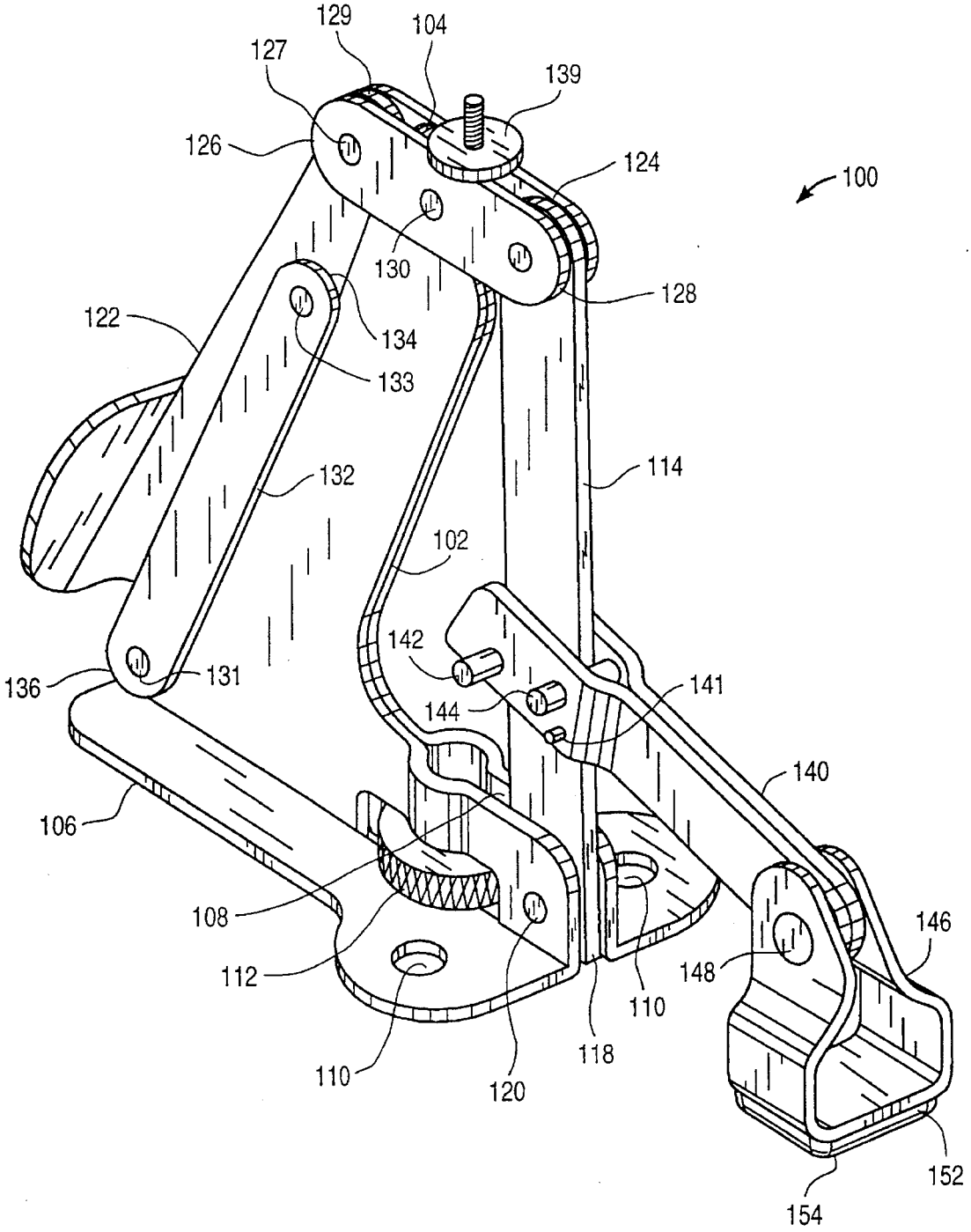
FIG. 4 is a perspective view of an exemplary embodiment of a clamp according to the present invention.
Figure 5:
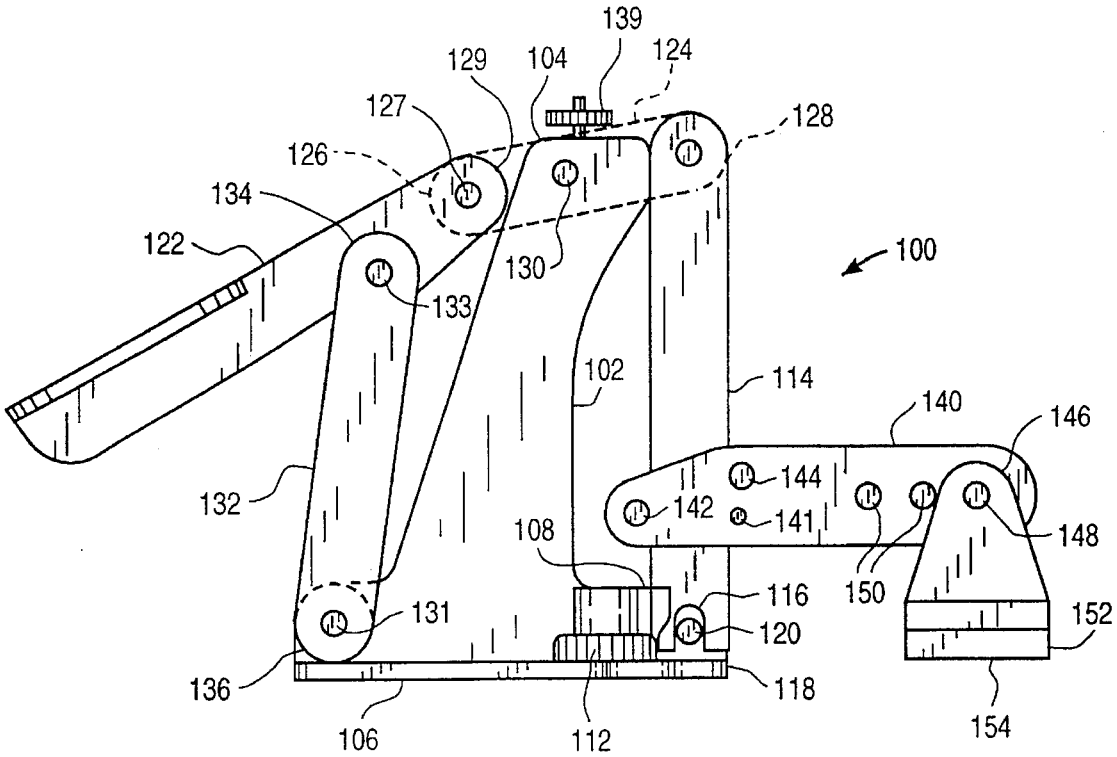
FIGS. 5–6 illustrate side views of the clamp of FIG. 4.
Figure 6:
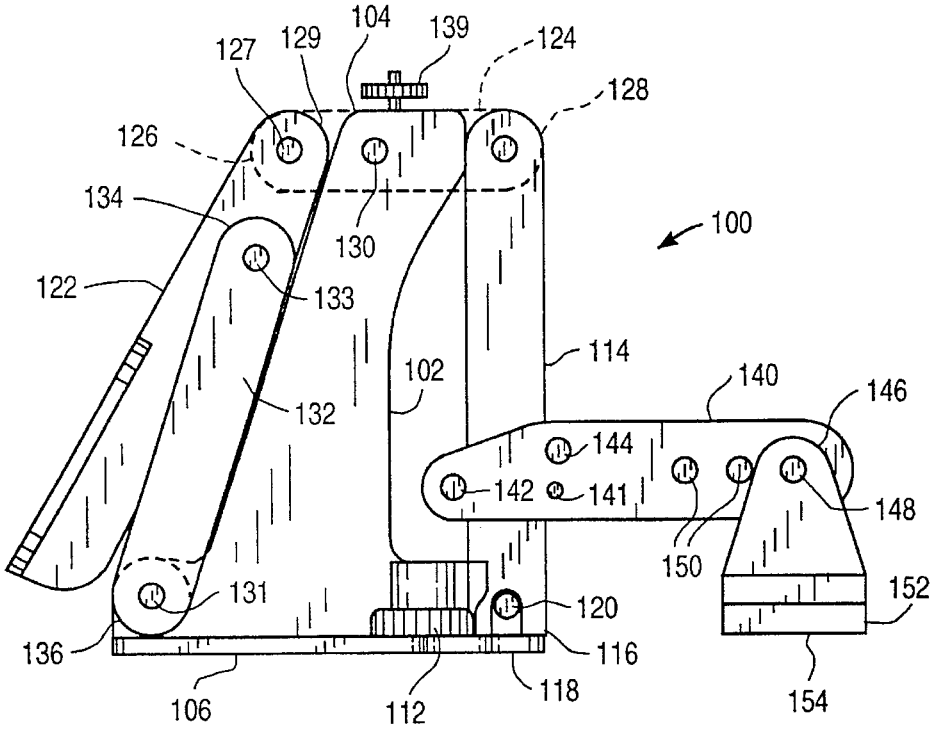

An exemplary embodiment of a clamp 100 is shown in FIGS. 4–6. The clamp 100 include a frame 102 having a top end 104 and a bottom end 106. Disposed at the bottom end 106 is a receiver aperture 108 (shown cut-away in FIGS. 5–6). Also disposed at the bottom end 106 are holes 110 that can be used to bolt or screw the clamp 100 to a mounting surface. A nut 112 can also be provided for receiving a bolt to further secure the clamp 100 to the mounting surface. A slide bar 114 is slidably mounted in an axial direction within the receiver aperture 112. The slide bar 114 includes a slot 116 at a proximal end 118. The slot is received over a pin 120 disposed across the receiver aperture 108. As will be described in greater detail hereinafter, the slot 116 has a curved geometry so that the slide bar 114 can maintain its axial alignment when clamping a work piece.

To drive the slide bar 114 in a downward direction, i.e. toward the pin 120, a handle 122 is provided. The handle 122 is connected to the slide bar 114 via a top linkage 124 (shown in phantom in FIGS. 5–6). The top linkage 124 has a proximal end 126 and a distal end 128. The top linkage 124 is pivotally attached to the frame 102 by a pivot bolt 130 between the proximal end 126 and the distal end 128. The top linkage 124 is pivotally attached near the distal end 128 to the slide bar 114 and is pivotally attached at the proximal end 126 to a distal end 129 of the handle 122 by pin 127. The handle in turn is pivotally connected to the frame 102 by a side linkage 132 having a top end 134 and a bottom end 136. The side linkage 132 is attached to the frame and the handle by pins 131 and 133, respectively. With this configuration, when the handle 122 is lifted, the proximal end 126 of the top linkage 124 is drawn in a downward direction. This causes the top linkage 124 to pivot about the frame 102 and raises the distal end 128 of the top linkage 124 as shown in FIG. 5. When the handle 122 is lowered, the distal end 128 of the top linkage 124 is also lowered and drives the slide bar 114 in a downward direction.

A holding arm 140 having biasing pins 142, 144 is slidably disposed on the slide bar 114. When the slide bar 114 is forced in a downward direction, the holding arm 140 is biased against the slide bar 114 by pins 142, 144 as previously described. Optionally, a thumbscrew (not shown) can be provided to secure the holding arm 140 to the slide bar 114 as previously described. A positioning pin 141 can also optionally be provided to assist in maintaining the holding arm 140 generally orthogonal to the slide bar 114 when positioning the holding arm 140 to engage a work piece. An engagement piece 146 is disposed on the holding arm 140 for engaging a work piece. Preferably, the engagement piece 146 is pivotally attached to the holding arm 140 by a pivot pin 148. As shown in FIGS. 5–6, a plurality of holes 150 can be disposed along the holding arm 140 to allow for various placement of the engagement piece 146. The engagement piece 146 further includes a replaceable tip 152 having a holding surface 154. Preferably, the replaceable tip 152 will be constructed from materials selected from the group consisting of wood, plastic, rubber, composites, and the like. These materials can be selected depending on the particular work piece to be clamped.

To assist in maintaining the slide bar 114 in an axial direction, the curved slot 116 is provided (as best shown in FIGS. 5–6 with the frame 102 shown cut-away). Fashioning of the slot 116 in this manner helps in maintaining the holding surface 154 against the work piece, i.e., so that the work piece will not pitch or roll, when the handle 122 is lowered.

The handle 122 is attached to the top linkage 124 and the side linkage 132 to provide an over-center locking mechanism. Over-center locking is accomplished by the position of pins 131, 133, and 127 as the handle is lowered. When the handle 122 is lowered, a point will be reached where the pins 131, 133, and 127 will be aligned to define a straight line, i.e. an over-center line. Further lowering of the handle 122 moves pin 133 beyond the over-center line as shown in FIG. 6 to lock the handle 122 in a stable snap-over position and secures the holding surface 154 against the work piece. The frame 102 is used to prevent further inward movement of the handle 122.

A thumbscrew 139 is provided at the top end 104 of the frame 102 to limit the upward travel of the slide bar 114. As the handle 122 is lifted, the slide bar 114 is raised until it touches the bottom of the thumbscrew 139 thereby limiting the upward movement of the slide bar 114 and the handle 122. To adjust the height to which the handle 122 can be raised, the thumbscrew 139 is adjusted by screwing it up or down. By limiting the travel of the slide bar 114, the maximum pressure applied to the work piece is also regulated. In this manner, the thumbscrew 139 allows the pressure applied to the work piece to be regulated regardless of the height of the work piece.

Figure 7:
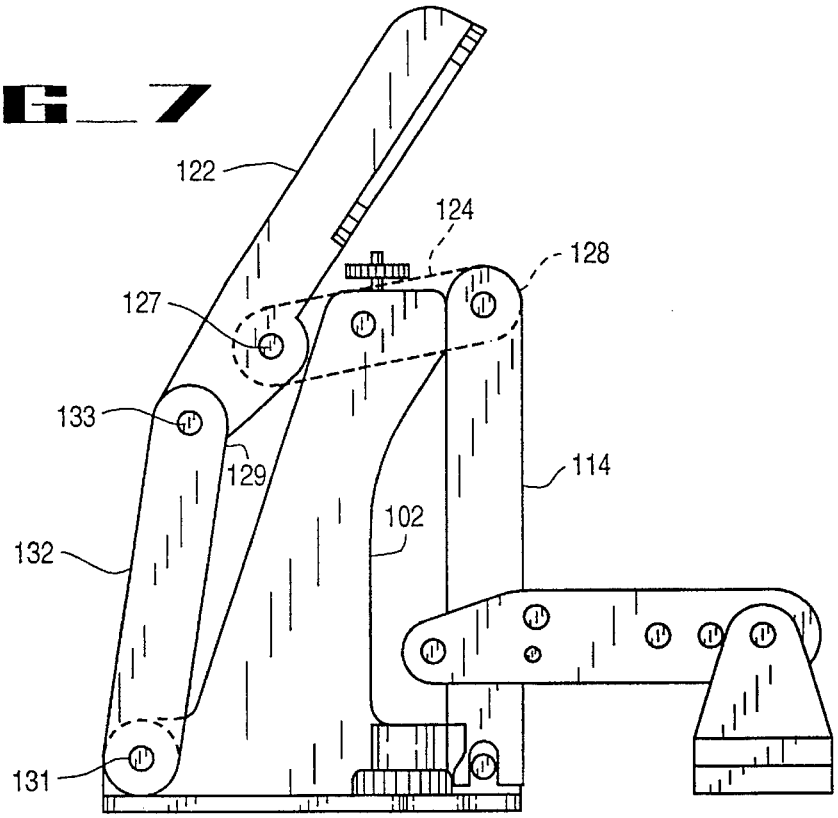
FIGS. 7–8 illustrate side views of an alternative embodiment of the clamp of FIGS. 4–6.
Figure 8:
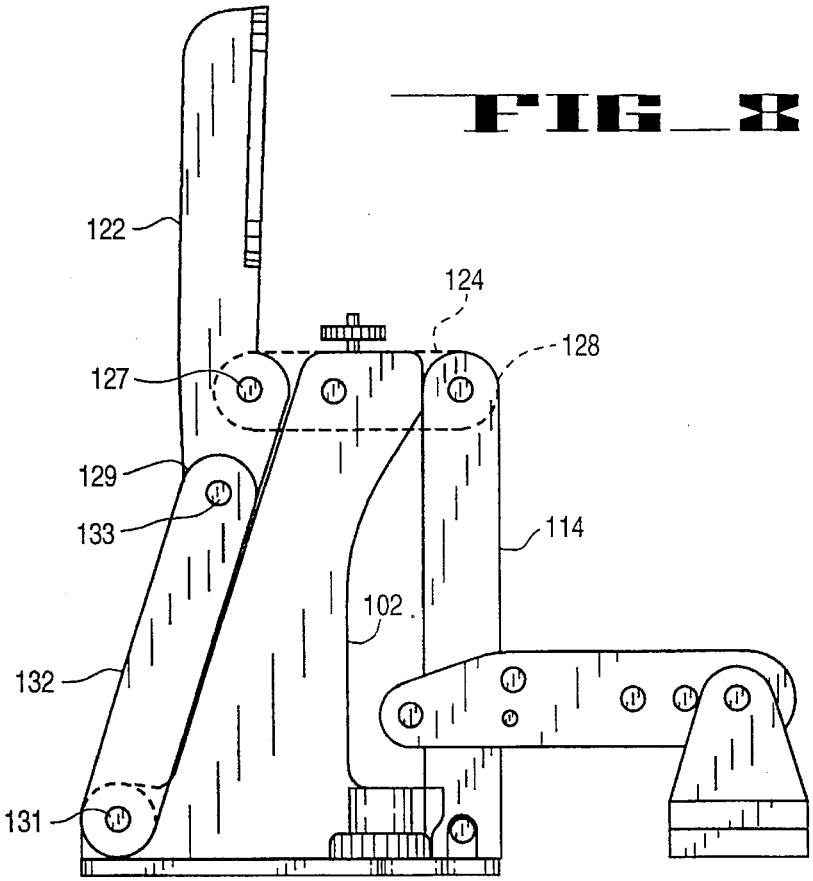

Shown in FIGS. 7–8 and 9–10 are two alternative embodiments of the clamp described in FIGS. 4–6. Both alternative embodiments use the same elements as described in FIGS. 4–6 but with some elements having a different orientation or being interchanged. This allows different embodiments of the clamp 100 to be produced from essentially the same parts. As shown in FIGS. 7–8, the orientation of the handle 122 is reversed so that the distal end 129 of the handle 122 is pivotally connected to the side bar 122 by pin 133. The handle 122 is also attached to the top linkage 124 by pin 127 just proximal to the distal end 129. With this configuration, as the handle is 122 is directed away from the frame 102, the top linkage 124 is lowered at its distal end 128 to drive the slide bar 114 downward. The slide bar 114 is locked in place as the pin 133 moves over-center (see FIG. 8) as previously described.

Figure 9:
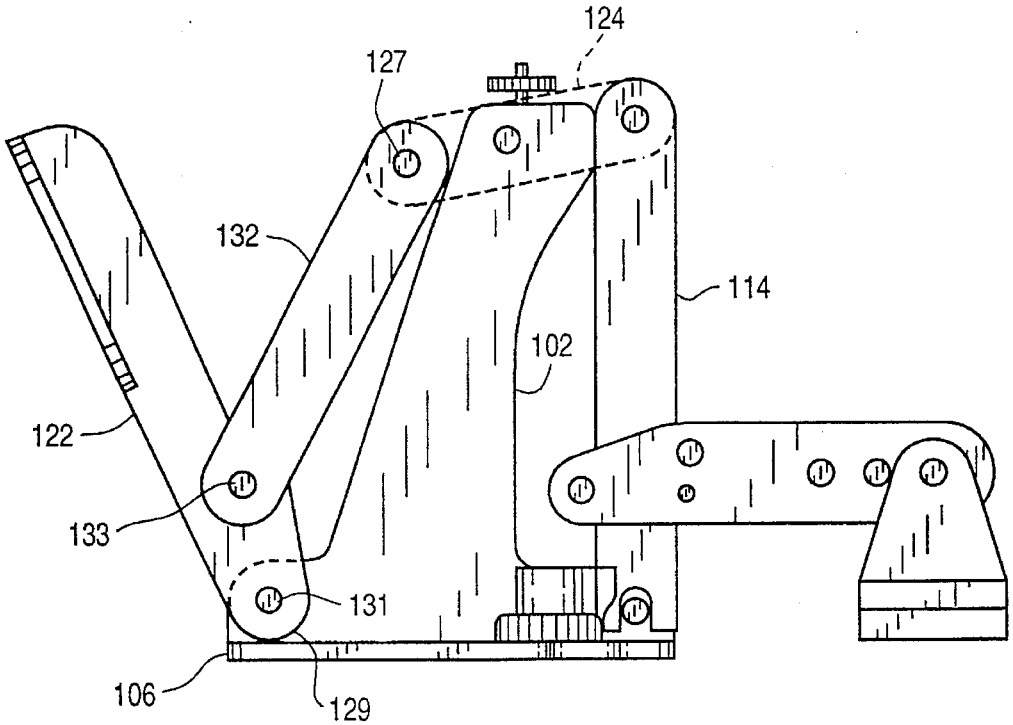
FIGS. 9–10 illustrate side views of another alternative embodiment of the clamp of FIGS. 4–6.
Figure 10:
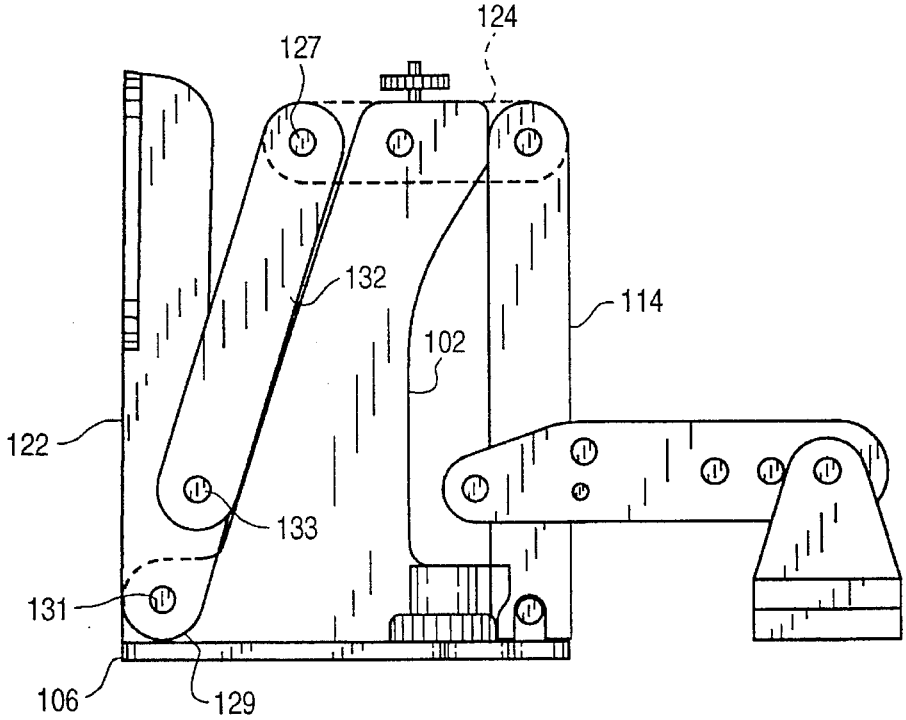

In the embodiment shown in FIGS. 9–10, the distal end 129 of the handle 122 is attached to the bottom end 106 of the frame 102 by pin 131. Between the handle 122 and the top linkage 124 is the side bar 132. Side bar 132 is attached to the handle 122 by pin 133 and to the top linkage 134 by pin 127. To secure a work piece, the handle 122 is advanced toward the frame 122 to drive the slide bar 114 in a downward direction. As the pivot pin 133 passes over-center (see FIG. 10), the slide bar 114 is locked into position as previously described.

The advantages of the present invention may now be readily understood. The invention allows the user to rapidly and safely clamp a piece of work into a steady position. The invention allows rapid adjustment of the clamp height through a large range and with variable pressure. The invention incorporates a disposable holding tip that will not damage tools should the operator err. When not attached to a bench, the clamp functions as a handle for the work. The design of the handle is such that it will not become disengaged while the handle is gripped by the operator.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A clamp for clamping a workpiece to a mounting surface comprising:

a frame having a top end and a bottom end, wherein a receiver aperture is disposed at the bottom end;

a slide bar slidably mounted in an axial direction within said receiver aperture;

driving means comprising a top linkage having a proximal end and a distal end, the top linkage being pivotally attached near said top end of said frame between said proximal and distal ends, said top linkage pivotally attached at said distal end to said slide bar, the driving means further comprising a handle for pivoting said top linkage about said frame to provide a downward axial force to said slide bar;

over-center locking means attached to said driving means for securely locking said slide bar in a downward position; and a holding arm having a holding surface at a distal end, said holding arm being slidably mounted to said slide bar, said slide bar positioned between a pair of biasing pins on said holding arm.

2. The clamp of claim 1, wherein said handle includes a proximal end for receiving an applied force and a distal end, and wherein said distal end is pivotally attached to said proximal end of said top linkage.

3. The clamp of claim 2, wherein the over-center locking means further comprises a side linkage having a bottom end and a top end, said bottom end of said side linkage pivotally attached to said frame near said bottom end of said frame, said top end of said side linkage attached to said handle between said proximal and distal ends and nearest said distal end, and wherein movement of said proximal end of said handle toward said bottom end of said frame causes said top end of said side linkage to move past a center line between said bottom end of said side linkage and said proximal end of said top linkage to lock said handle in a stable snap-over position.

4. The clamp of claim 1, wherein said handle includes a proximal end for receiving an applied force and a distal end, and wherein said handle is pivotally attached to said proximal end of said top linkage between said proximal and distal ends and nearest the distal end.

5. The clamp of claim 4, wherein the over-center locking means further comprises a side linkage having a bottom end and a top end, said bottom end of said side linkage pivotally attached to said frame near said bottom end of said frame, said top end of said side linkage attached to said distal end of said handle, and wherein movement of said proximal end of said handle away from said slide bar causes said top end of said side linkage to move past a center line between said bottom end of said side linkage and said proximal end of said top linkage to lock said handle in a stable snap-over position.

6. The clamp of claim 1, wherein said handle includes a proximal end for receiving an applied force and a distal end, and wherein said handle is pivotally attached to said frame near said bottom end.

7. The clamp of claim 6, wherein the over-center locking means further comprises a side linkage having a bottom end and a top end, said bottom end of said side linkage pivotally attached to said handle proximal to said distal end, said top end of said side linkage attached to said proximal end of said top linkage, and wherein movement of said proximal end of said handle toward said slide bar causes said bottom end of said side linkage to move past a center line between said distal end of said handle and said proximal end of said top linkage to lock said handle in a stable snap-over position.

8. The clamp of claim 1, wherein a slot is disposed at a proximal end of the slide bar, the slot being received within a pin across said aperture.

9. The clamp of claim 8, wherein the slot is curved to maintain the slide bar in a generally axial orientation when said downward driving force is provided.

10. The clamp as in claim 1, wherein said top linkage is pivotally attached to said frame by a pivot bolt.

11. The clamp as in claim 1, further comprising means for securing said holding arm to said slide bar.

12. The clamp as in claim 11, wherein said securing means comprises a thumbscrew.

13. The clamp as in claim 1, further comprising means for limiting the upward travel of said slide bar.

14. The clamp as in claim 13, wherein said limiting means comprises a thumbscrew rotatably retained within said top end of said frame.

15. The clamp as in claim 1, further comprising a replaceable tip attached to said holding arm.

16. The clamp as in claim 15, wherein said holding surface is emplaced on said replaceable tip.

17. The clamp as in claim 16, wherein said replaceable tip is constructed from materials selected from the group consisting of wood, plastic, rubber, and composites.

18. The clamp as in claim 1, wherein said frame is mounted to said mounting surface at said bottom end by mounting means.

19. The clamp as in claim 3, wherein said handle substantially conforms to said frame after said handle is lowered to said stable snap-over position, said frame preventing further travel of said handle.

* * * * *